United States Patent [19]

Byers

[11] Patent Number: 4,705,522

[45] Date of Patent: Nov. 10, 1987

[54] ALKOLXY DERIVATIVE STABILIZERS FOR DYE-RECEIVING ELEMENT USED IN THERMAL DYE TRANSFER

[75] Inventor: Gary W. Byers, Webster, N.Y.

[73] Assignee: Eastman Kodak Company, Rochester, N.Y.

[21] Appl. No.: 899,274

[22] Filed: Aug. 22, 1986

[51] Int. Cl.[4] ..... B41M 5/26

[52] U.S. Cl. ..... 8/471; 427/146; 427/256; 427/372.2; 427/384; 427/385.5; 428/195; 428/411.1; 428/480; 428/913; 428/914; 430/945

[58] Field of Search ..... 8/470, 471; 428/195, 428/913, 914, 411.1, 480; 430/945; 427/256, 384, 385.5, 372.2, 146

[56] References Cited

FOREIGN PATENT DOCUMENTS

| | | | |
|---|---|---|---|
| 147747 | 7/1985 | European Pat. Off. | 8/471 |
| 59-182785 | 10/1984 | Japan | 8/471 |
| 0224844 | 12/1984 | Japan | 428/914 |

*Primary Examiner*—Bruce H. Hess
*Attorney, Agent, or Firm*—Harold E. Cole

[57] ABSTRACT

A dye-receiving element for thermal dye transfer process and assemblage comprises a support having thereon a dye image-receiving layer and a stabilizer compound having the following moiety:

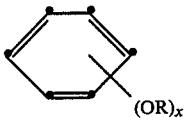

wherein each R is independently an alkyl or substituted alkyl group of from 1 to about 20 carbon atoms, or two adjacent R groups may be joined together to form methylene or ethylene; and x is as least 3.

Dyes which are transferred to this receiving element have improved light stability.

20 Claims, No Drawings

ALKOLXY DERIVATIVE STABILIZERS FOR DYE-RECEIVING ELEMENT USED IN THERMAL DYE TRANSFER

This invention relates to dye-receiving elements used in thermal dye transfer, and more particularly to the use of a particular stabilizer compound in the dye image-receiving layer.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method for Controlling A Thermal Printer Apparatus," issued Nov. 4, 1986, the disclosure of which is hereby incorporated by reference.

In Japanese laid open publication No. 59/182,785 and European Patent Application No. 147,747, an image-receiving element for thermal dye transfer printing is disclosed. The dye image-receiving layer disclosed contains a stabilizer compound which is a di-alkoxy derivative. The stabilizer provides a certain measure of stability to light for dyes which are transferred to the dye-receiving element.

There is a problem with these stabilizers in that they are not as effective as one would desire. As will be shown by comparative tests hereinafter, the stabilizers of the invention which contain at least 3 alkoxy groups are more effective than the prior art compounds which contain only 2 alkoxy groups.

It would be desirable to improve the stability to light of dyes which are transferred to a dye image-receiving layer by using a more effective stabilizer.

In accordance with this invention, a dye-receiving element for thermal dye transfer is provided which comprises a support having thereon a dye image-receiving layer and a stabilizer compound having the following moiety:

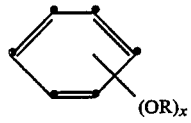

wherein each R is independently an alkyl or substituted alkyl group of from 1 to about 20 carbon atoms, or two adjacent R groups may be joined together to form methylene or ethylene; and x is at least 3.

In a preferred embodiment of the invention, the stabilizer compound has the following formula:

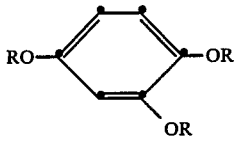

wherein each R is defined as above.

In another preferred embodiment of the invention, the stabilizer compound has the following formula:

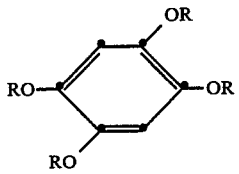

wherein each R is defined as above.

In yet another preferred embodiment of the invention, each R in the above formulas is an alkyl group of 1 to about 10 carbon atoms.

The stabilizer compounds of the invention may be present in any concentration which is effective for the intended purpose. Generally, good results have been obtained when the stabilizer compounds are present at a concentration of at least about 1% by weight of the dye image-receiving layer, preferably from about 5 to about 20% by weight.

Specific compounds included within the scope of this invention are as follows:

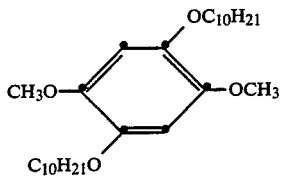

(1)

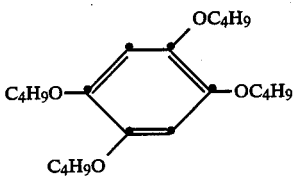

(2)

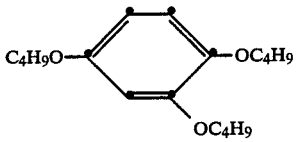

(3)

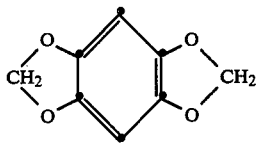

(4)

-continued (5)

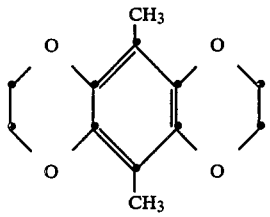

(6)

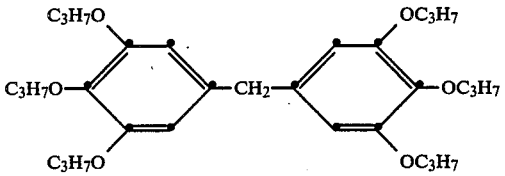

(7)

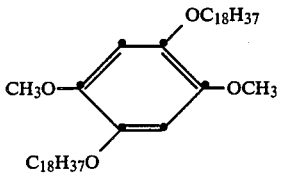

(8)

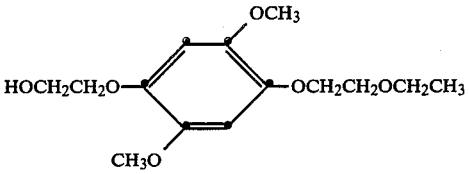

(9)

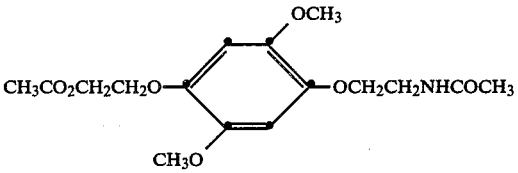

(10)

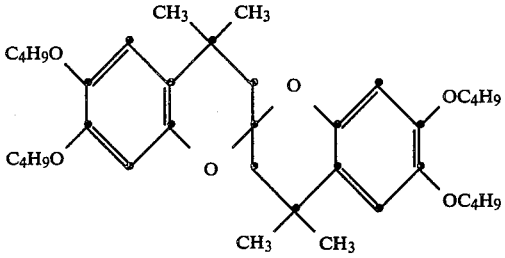

The support for the dye-receiving element of the invention may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek ®. In a preferred embodiment, polyester with a white pigment incorporated therein is employed.

The dye-image-receiving layer may comprise, for example, a polycarbonate, a polyurethane, a polyester, polyvinyl chloride, poly(styrene-co-acrylonitrile), poly(caprolactone), or mixtures thereof. The dye image-receiving layer may be present in any amount which is effective for the intended purpose. In general, good results have been obtained at a concentration of from about 1 to about 5 g/m$^2$.

A dye-donor element that is used with the dye-receiving element of the invention comprises a support having thereon a dye layer. Any dye can be used in such a layer provided it is transferable to the dye image-receiving layer of the dye-receiving element of the invention by the action of heat. Especially good results have been obtained with sublimable dyes. Examples of sublimable dyes include anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.), azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

(magenta)

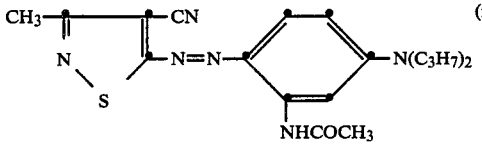

(yellow)

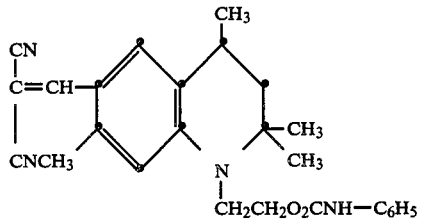

(cyan)

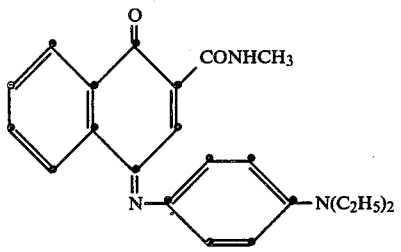

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether imides. The support generally has a thickness of from about 2 to about 30 $\mu$m. It may also be coated with a subbing layer, if desired.

A dye-barrier layer comprising a hydrophilic polymer may also be employed in the dye-donor element between its support and the dye layer which provides improved dye transfer densities.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

As noted above, dye-donor elements are used to form a dye transfer image. Such a process comprises imagewise-heating a dye-donor element and transferring a dye image to a dye-receiving element as described above to form the dye transfer image. An additional step of heating the dye-receiving element containing the transferred dye image will reduce stratification of the transferred image dye in the dye-receiving element. This can be done using a separate heated roller or heating apparatus, or the thermal print head itself can be used in the heating step as disclosed and claimed in copending U.S. application Ser. No. 879,690 filed June 27, 1986, by Vanier et al. entitled "Non-imagewise Reheating of Transferred Dyes in Thermal Dye Transfer Elements."

The dye-donor element employed in certain embodiments of the invention may be used in sheet form or in a continuous roll or ribbon. If a continuous roll or ribbon is employed, it may have only one dye thereon or may have alternating areas of different dyes, such as cyan, magenta, yellow, black, etc., as disclosed in U.S. Pat. No. 4,451,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements employed in the invention are available commercially. There can be employed, for example, a Fujitsu Thermal Head (FTP-040 MCS001), A TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

Comparative Example

A yellow dye-donor element was prepared by coating a dye layer containing the following yellow dye (0.22 g/m$^2$) in cellulose acetate butyrate (17% butyryl) (28% acetyl) (0.32 g/m$^2$) coated from a 2-butanone, acetone and cyclopentanone solvent mixture on a 6 $\mu$m poly(ethylene terephthalate) support:

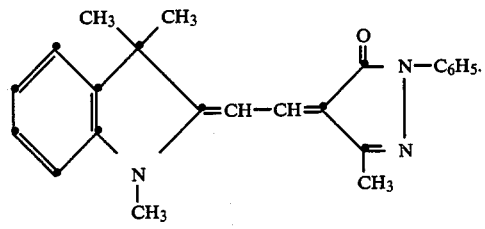

This compound is the subject of patent application Ser. No. 915,441 of Byers and Chapman filed Oct. 6, 1986.

A slipping layer was coated on the back side of the element similar to that disclosed in U.S. application Ser. No. 925,949 of Vanier et al. filed Nov. 3, 1986.

Dye receiving elements according to the invention were prepared by coating a solution of Bayer AG Makrolon 5705 ® Polycarbonate (2.9 g/m$^2$) and the amount as indicated in Table 1 of stabilizer compounds 1, 2, 3 and 10 (equivalent to 1.35 mmoles/m$^2$) from a methylene chloride and trichloroethylene solvent mixture on top of an ICI Melinex ® 990 "White Polyester" reflective support.

Control receiving elements were prepared as above except that they had the following dialkoxy derivative stabilizers:

Control 1 Stabilizer

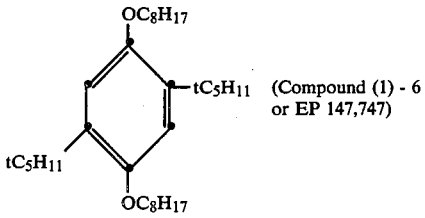

Control 2 Stabilizer

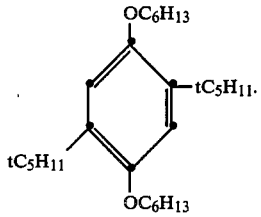

The dye side of each yellow dye-donor element was placed in contact with the dye image-receiving layer of the dye-receiver element one inch wide. The assemblage was fastened in the jaws of a stepper motor driven pulling device. The assemblage was laid on top of a 0.55 in (14 mm) diameter rubber roller and a TDK Thermal Head (No. L-133) and was pressed with a spring at a force of 8.0 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidently, the resistive elements in the thermal print head were pulse-heated at increments from 0 to 8.3 msec to generate a graduated density test pattern. The voltage supplied to the print head was approximately 22 v representing approximately 1.5 watts/dot (12 mjoules/dot) for maximum power.

The dye-receiver was separated from each of the dye donors and the Status A blue reflection density of each stepped image was read. Each image was then subjected to "HID fading" for 3 days, 50 kLux, 5400°, 32° C., approximately 25% RH. The density was re-read and the percent density losses at selected steps were calculated. The following results were obtained:

TABLE 1

| | Step 5 | | Step 3 | |
|---|---|---|---|---|
| Stabilizer (g/m$^2$) | Init Dens. | % Loss After Fade | Init. Dens. | % Loss After Fade |
| Control 1 (0.64) | 1.7 | 62 | 0.5 | 89 |
| Control 2 (0.56) | 1.9 | 50 | 0.7 | 78 |
| Compound 1 (0.61) | 2.3 | 20 | 0.9 | 48 |
| Compound 2 (0.49) | 2.1 | 28 | 0.8 | 57 |
| Compound 3 (0.40) | 2.1 | 32 | 0.7 | 62 |
| Compound 10 (0.80) | 2.1 | 30 | 0.8 | 56 |

The results indicate that the stabilizers according to the invention containing three or four alkoxy groups provided better stability to light than closely related prior art compounds having only two alkoxy groups.

EXAMPLE 2

Reheating

Dye-donor elements and dye-receiving elements were prepared similar to those of Example 1 as specified in Table 2, except that the support of the dye-donor element was first coated with a dye-barrier layer of acrylic acid in an acetone, methanol and water solvent mixture (0.16 g/m$^2$). A blank dye-donor element was prepared similar to the dye-donor element above except that there was no dye layer coated on top of the acrylic acid barrier layer.

Dye transfer was performed as in Example 1. The dye-receiver was then separated from each dye-donor element and placed in contact with the barrier layer side of the blank dye-donor element. Uniform reheating of the entire stepped image on the reveiver at the full-power setting (i.e., that used originally to provide maximum dye density) was performed in the manner as described above. The following results were obtained:

TABLE 2

| | | Step 8 ($D_{max}$) | | Step 6 | | Step 4 | |
|---|---|---|---|---|---|---|---|
| Stabilizer | Reheated | Init. Dens. | % Loss After Fade | Init. Dens. | % Loss After Fade | Init. Dens. | % Loss After Fade |
| None | No | 2.4 | 36 | 1.5 | 45 | 0.8 | 47 |
| Compound 1 | No | 2.0 | 11 | 1.4 | 20 | 0.7 | 36 |
| | Yes | 2.4 | 5 | 1.4 | 7 | 0.8 | 8 |
| Compound 2 | No | 2.1 | 10 | 1.4 | 18 | 0.8 | 37 |
| | Yes | 2.2 | 4 | 1.3 | 6 | 0.8 | 8 |

The results indicate that the stabilizers according to the invention provided better stability to light than the receiver without any stabilizer, and that reheating the receiver provided a further dramatic increase in stability.

EXAMPLE 3

Higher Concentration of Stabilizer

Dye-receiving elements and dye-donor elements were prepared similar to Example 2 except that the dye-receiver element contained 2.9 g/m$^2$ polycarbonate resin and 0.65 g/m$^2$ stabilizer.

The dye side of a yellow dye-donor element strip 1.0 inch (25 mm) wide was placed in contact with the dye image-receiving layer of the dye-receiver element of the same width. The assemblage was fastened in the jaws of a stepper motor driven pulling device. The assemblage was laid on top of a 0.55 in. (14 mm) diameter rubber roller and a Fujitsu Thermal Head (FTP-040MCS001) was pressed with a spring at a force of 3.5 pounds (1.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were heated at 0.5 msec increments from 0 to 4.3 msec to generate a graduated density test pattern. The voltage supplied to the print head was approximately 19 v representing approximately 1.5 watts/dot (6 mjoules/dot) for maximum power.

The elements were then processed as in Example 1 with the following results:

TABLE 3

| | Step 8 ($D_{max}$) | | Step 6 | | Step 4 | |
|---|---|---|---|---|---|---|
| Stabilizer | Init. Dens. | % Loss After Fade | Init. Dens. | % Loss After Fade | Init. Dens. | % Loss After Fade |
| None | 1.8 | 57 | 1.1 | 69 | 0.6 | 88 |
| Control 1 | 1.7 | 19 | 1.0 | 37 | 0.5 | 60 |
| Compound 1 | 1.8 | 8 | 1.1 | 14 | 0.6 | 25 |

The above results again illustrate that the stabilizer compound of the invention at a higher concentration had better stability to light than a closely related compound of the prior art.

EXAMPLE 4

Black Dye

A neutral or black dye-donor element was prepared as in Example 2 except that the following dye was employed at 0.75 g/m$^2$ in 0.65 g/m$^2$ cellulose acetate hydrogen phthalate (18–21% acetyl, 32–26% phthalyl:

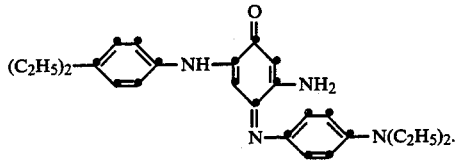

Dye-receiving elements were prepared as in Example 1. The elements were then processed as in Example 1 except that each step area was read before and after fade to Status A red, blue and green density. The following results were obtained:

TABLE 4

| | Step 8 ($D_{max}$) | | | | | | Step 4 | | | | | |
|---|---|---|---|---|---|---|---|---|---|---|---|---|
| | Red | | Green | | Blue | | Red | | Green | | Blue | |
| Stabilizer | Init. Dens. | % Loss After Fade | Init. Dens. | % Loss After Fade | Init. Dens. | % Loss After Fade | Init. Dens. | % Loss After Fade | Init. Dens. | % Loss After Fade | Init. Dens. | % Loss After Fade |
| None | 1.1 | 28 | 1.3 | 23 | 1.3 | 12 | 0.4 | 69 | 0.4 | 62 | 0.4 | 44 |
| Compound 1 | 1.1 | 22 | 1.3 | 17 | 1.3 | 9 | 0.4 | 53 | 0.4 | 44 | 0.4 | 28 |
| Compound 2 | 1.2 | 24 | 1.3 | 18 | 1.3 | 10 | 0.4 | 56 | 0.4 | 48 | 0.4 | 31 |

The above results again illustrate the effectiveness of the stabilizer compounds of the invention with a neutral dye.

EXAMPLE 5

Magenta Dye

Dye-receiving elements were prepared similar to those of Example 1.

A magenta dye-donor element was prepared by coating the following layers in the order recited on a 6 μm poly(ethylene terephthalate) support:

(1) Dye barrier layer of poly(acrylic acid) (0.17 g/m$^2$) coated from a water-methanol solvent mixture; and (2) Dye layer containing the following magenta dye (0.22 g/m$^2$) in a cellulose acetate hydrogen phthalate (32–36% phthalyl) (18–21% acetyl) binder (0.38 g/m$^2$) and an acetone, butanone and cyclohexanone solvent mixture:

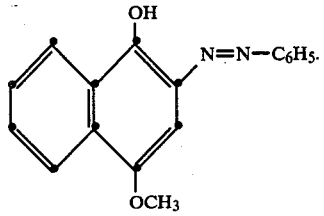

The elements were then processed as in Example 1 except that the dye-fade conditions were for 2 days at 5.4 klux. The following results were obtained for a Status A green reflection density:

TABLE 5

| | Step 8 ($D_{max}$) | | Step 4 | |
|---|---|---|---|---|
| Stabilizer (g/m$^2$) | Init. Dens. | % Loss After Fade | Init. Dens. | % Loss After Fade |
| Control 1 (0.64) | 1.8 | 14 | 0.6 | 41 |
| Control 2 (0.56) | 2.0 | 12 | 0.6 | 32 |
| Compound 1 (0.61) | 2.0 | 10 | 0.7 | 12 |
| Compound 2 (0.49) | 2.1 | 9 | 0.7 | 16 |
| Compound 3 (0.40) | 2.2 | 11 | 0.7 | 19 |
| Compound 10 (0.80) | 2.0 | 11 | 0.6 | 20 |

The above results illustrate the effectiveness of compounds of the invention with a magenta dye.

EXAMPLE 6

Concentration Series

A black dye-donor element was prepared as in Example 4 except that the dye had the following structrure:

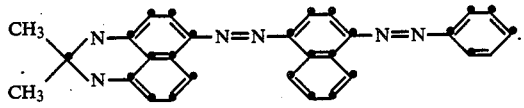

Sudan Black B

A yellow dye-donor element was prepared as in Example 1 except that the dye had the following structure:

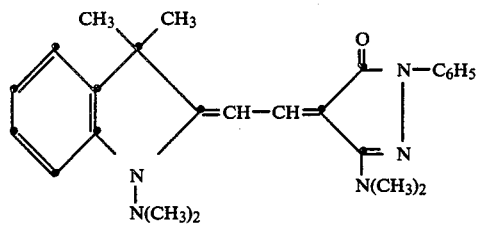

Dye receiving elements were prepared as in Example 1 except that stabilizer compound 1 was employed at the following concentrations 0.016, 0.27 and 0.54 g/m$^2$.

The elements were then processed as in Example 1 with the following results:

TABLE 6A

| | Black Dye Status A Red Density | | | |
|---|---|---|---|---|
| | Step 8 ($D_{max}$) | | Step 5 | |
| Stabilizer (g/m$^2$) | Init. Dens. | % Loss After Fade | Init. Dens. | % Loss After Fade |
| None | 2.2 | 28 | 0.9 | 49 |
| Compound 1 (0.16) | 2.2 | 21 | 0.9 | 42 |
| Compound 1 (0.27) | 2.5 | 20 | 1.0 | 38 |
| Compound 1 (0.54) | 2.5 | 4 | 1.2 | 27 |

TABLE 6B

| | Yellow Dye Status A Blue Density | | | |
|---|---|---|---|---|
| | Step 8 ($D_{max}$) | | Step 5 | |
| Stabilizer (g/m$^2$) | Init. Dens. | % Loss After Fade | Init. Dens. | % Loss After Fade |
| None | 1.6 | 18 | 0.8 | 59 |
| Compound 1 (0.16) | 2.0 | 13 | 1.0 | 32 |
| Compound 1 (0.27) | 2.1 | 12 | 1.0 | 28 |
| Compound 1 (0.54) | 2.3 | 7 | 1.3 | 16 |

The above results illustrate the increasing effectiveness of a stabilizer compound of the invention at increasing concentrations.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having thereon a dye image-receiving layer and a stabilizer compound having the following moiety:

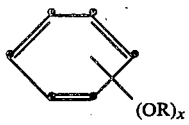

wherein each R is independently an alkyl or substituted alkyl group of from 1 to about 20 carbon atoms, or two adjacent R groups may be joined together to form methylene or ethylene; and x is at least 3.

2. The element of claim 1 wherein said stabilizer compound has the formula:

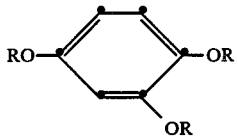

wherein each R is defined as in claim 1.

3. The element of claim 2 wherein each R is independently an alkyl group of from 1 to about 10 carbon atoms.

4. The element of claim 1 wherein said stabilizer compound has the formula:

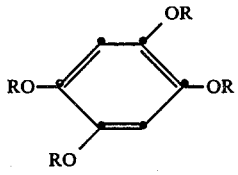

wherein each R is defined as in claim 1.

5. The element of claim 4 wherein each R is independently an alkyl group of from 1 to about 10 carbon atoms.

6. The element of claim 1 wherein said stabilizer compound has the formula:

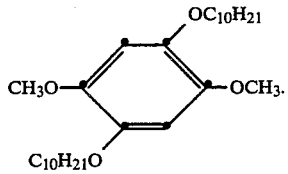

7. The element of claim 1 wherein said stabilizer compound has the formula:

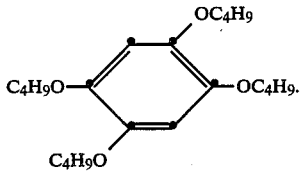

8. The element of claim 1 wherein said stabilizer compound has the formula:

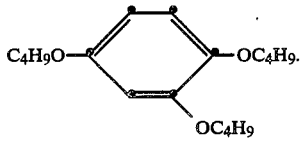

9. The element of claim 1 wherein said stabilizer is present at a concentration of at least about 1% by weight of the dye image-receiving layer.

10. In a process of forming a dye transfer image comprising imagewise-heating a dye-donor element comprising a support having thereon a dye layer and transferring a dye image to a dye-receiving element to form said dye transfer image, said dye-receiving element comprising a support having thereon a dye image-receiving layer, the improvement wherein said dye image-receiving layer contains a stabilizer compound having the following moiety:

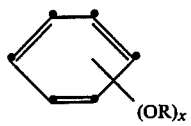

wherein each R is independently an alkyl or substituted alkyl group of from 1 to about 20 carbon atoms, or two adjacent R groups may be joined together to form methylene or ethylene; and x is at least 3.

11. The process of claim 10 wherein said stabilizer compound has the formula:

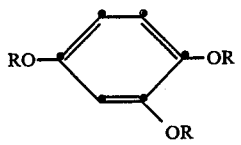

wherein each R is defined as in claim 10.

12. The process of claim 10 wherein said stabilizer compound has the formula:

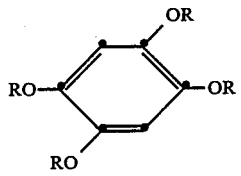

wherein each R is defined as in claim 10.

13. The process of claim 10 wherein the support for the dye-donor element comprises poly(ethylene terephthalate) which is coated with sequential repeating areas of cyan, magenta and yellow dye, and said process steps are sequentially performed for each color to obtain a three-color dye transfer image.

14. The process of claim 10 wherein said dye-receiving element containing said transferred dye image is heated.

15. In a thermal dye transfer assemblage comprising:

(a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer, the improvement wherein said dye image-receiving layer contains a stabilizer compound having the following moiety:

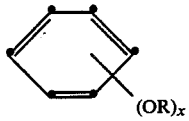

wherein each R is independently an alkyl or substituted alkyl group of from 1 to about 20 carbon atoms, or two adjacent R groups may be joined together to form methylene or ethylene; and x is at least 3.

16. The assemblage of claim 15 wherein said stabilizer compound has the formula:

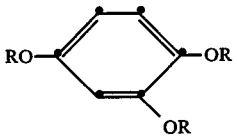

wherein each R is defined as in claim 14.

17. The assemblage of claim 16 wherein each R is independently an alkyl group of from 1 to about 10 carbon atoms.

18. The assemblage of claim 15 wherein said stabilizer compound has the formula:

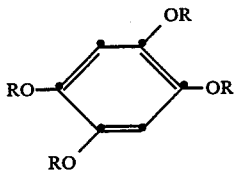

wherein each R is defined as in claim 14.

19. The assemblage of claim 18 wherein each R is independently an alkyl group of from 1 to about 10 carbon atoms.

20. The assemblage of claim 15 wherein said stabilizer is present at a concentration of at least about 1% by weight of the dye image-receiving layer.

* * * * *